US005139238A

United States Patent [19]

Buhr

[11] Patent Number: 5,139,238

[45] Date of Patent: Aug. 18, 1992

[54] CERAMIC FILTERS IN REFRACTORY BODIES FOR CLEANING MOLTEN METAL

[75] Inventor: Heinz Buhr, Meerbusch, Fed. Rep. of Germany

[73] Assignee: Didier-Werke AG, Wiesbaden, Fed. Rep. of Germany

[21] Appl. No.: 671,984

[22] Filed: Mar. 19, 1991

[30] Foreign Application Priority Data

Apr. 14, 1990 [DE] Fed. Rep. of Germany ..... 4012093

[51] Int. Cl.[5] ..... B22D 41/08

[52] U.S. Cl. ..... 266/238; 222/600

[58] Field of Search ..... 222/600, 591; 266/227, 266/230, 238, 236; 164/134, 358, 337

[56] References Cited

U.S. PATENT DOCUMENTS

| | | | |
|---|---|---|---|
| 4,573,616 | 3/1986 | Shapland | 222/600 |
| 4,765,833 | 8/1988 | Narumiya et al. | 266/227 |
| 4,789,140 | 12/1988 | Lirones | 164/134 |
| 4,928,746 | 5/1990 | Butler et al. | 164/358 |
| 4,990,059 | 2/1991 | James | 266/227 |
| 5,004,545 | 4/1991 | Wahl et al. | 266/227 |

FOREIGN PATENT DOCUMENTS

| | | |
|---|---|---|
| 547568 | 3/1932 | Fed. Rep. of Germany . |
| 3700107 | 7/1988 | Fed. Rep. of Germany . |

*Primary Examiner*—Scott Kastler
*Attorney, Agent, or Firm*—Wenderoth, Lind & Ponack

[57] ABSTRACT

An interchangeable wearable refractory part for a discharge opening of a metallurgical vessel is provided with at least one ceramic filter for filtering a molten metal stream. The refractory part, such as a sliding valve plate, casting pipe, discharge sleeve or nozzle, or stationary base plate, may have the ceramic filter mounted in a passage opening thereof. The refractory parts are wearable, and thus are from time to time, replaced. The service life of the ceramic filters are chosen to correspond with the life span of the refractory part. The ceramic filter can either be a single filter in the passage opening, or a multi-stage filter including a coarse filter for larger impurities, a fine filter for smaller impurities as well as an absorption or reaction filter for dissolved impurities.

35 Claims, 1 Drawing Sheet

CERAMIC FILTERS IN REFRACTORY BODIES FOR CLEANING MOLTEN METAL

BACKGROUND OF THE INVENTION

1. Field of the Invention

The present invention relates to apparatus for cleaning molten metal, in particular molten steel. More particularly, the present invention relates to cleaning molten metal while pouring the molten metal from a metallurgical vessel with ceramic filters mounted in supporting refractory bodies.

2. Background of the Invention

It has lately become more important to properly clean molten steel. The goal of the cleaning is to remove non-metallic impurities, such as carbides and oxides, from the molten steel. Well known ceramic filters, based for example on zirconium, have been used to clean to molten steel. To date, expensive filter systems, such as that disclosed in DE-PS 3 700 107, have been used to clean molten steel. These systems are disposed in the flow path of the molten metal or molten steel, and have filters which can be replaced only with tedious interruptions of the casting or pouring process. Indeed, the interruptions of the casting or pouring are so troublesome that in many situations the filtration of the molten metal is entirely dispensed with.

SUMMARY OF THE INVENTION

The object of the present invention is to enable the replacement of ceramic filters during pouring operations of steel in a simple and quick manner, by using refractory members already in use during the pouring of the molten metal, thus facilitating the filtration of the molten metal.

The above object of the present invention is accomplished by the provision of an interchangeable, wearable refractory part for a discharge opening of a metallurgical vessel, the interchangeable wearable refractory part comprising a refractory body having a passage opening therethrough for molten metal, and at least one ceramic filter supported by the refractory body for filtering the molten metal flowing through the passage opening of the refractory body.

Such interchangeable wearable refractory parts are typically employed in discharge nozzles and valves of metallurgical vessels used to pour molten steel. Such interchangeable wearable refractory parts may take the form of sliding valve plates used to open and shut off the flow of molten metal from the metallurgical vessel, casting pipes or nozzles used to conduct molten metal from the vessel into a casting mold, tapping discharge nozzles mounted with sliding valve plates, collector nozzles mounted with sliding valve plates, and even stationary plates used in sliding gate valves. These parts of the discharge system of the metallurgical vessel must, from time to time, be replaced, due to the destructive stresses of the molten metal flowing through these parts. Thus these parts can be replaced during shutoff of a pouring operation.

By employing interchangeable wearable refractory parts as carriers for ceramic filters, it is then possible to stop a pouring or casting operation for a short period of time, replace the clogged ceramic filters and subsequently continue the casting process, without any significant problems arising because of the stoppage of the operation. The result of this is a significantly expanded field of application for ceramic molten metal filters, especially in the areas of continuous and ingot casting. Discharge nozzles and valves used in continuous and ingot casting can easily use the interchangeable wearable refractory parts thereof to filter the molten metal, especially since the interchangeable wearable refractory part, with a ceramic filter or filters held securely in its passage opening, forms a component which is convenient to handle.

In a preferred form of the invention, the passage opening of the interchangeable wearable refractory part has an expanded portion, the ceramic filter or filters being disposed in the expanded portion. The expanded portion may be conical or cylindrical in order to create a larger filter space for the molten metal, as well as to provide a more reliable supporting base for the filter.

Another preferred feature of the invention lies in connecting a ceramic filter to the interchangeable wearable refractory part such that a clogged ceramic filter can be easily replaced with a new filter on the refractory part if the refractory part is still useable. More particularly, the interchangeable wearable refractory part may be a nozzle having a metal casing, and the ceramic filter having a metal casing, with a connecting arrangement operable between the metal casings to removably connect the ceramic filter to an end of the nozzle such that molten metal flowing through the nozzle will flow through the filter. This arrangement thus allows an interchangeable filter unit to be arranged at the discharge end of the discharge nozzle for easy access to the filter unit.

Another preferred feature of the present invention lies in the provision of a number of successive ceramic filters of different porosity being disposed in the passage opening of the refractory body of the interchangeable wearable refractory part. One filter may be provided for coarse impurities, and a second filter may be provided for fine impurities downstream of the coarse filter. A third filter can also be provided as an absorption or reaction filter. The desired filter capacity can then be achieved through staggered filtration of the molten metal through the passage opening of the refractory body. The absorption or reaction filter operates to remove impurities which are dissolved in the molten metal. In general, when a ceramic filter is chosen, several factors must be taken into account: the capacity of the ceramic filter must meet the desired degree of filtration for the volume of molten metal to be filtered, and the accumulation of impurities in the ceramic filter should parallel, to as great a degree as possible, the wear of the interchangeable wearable refractory part.

Continuous pusher-type slide gate valves, having discharge nozzles, are particularly suitable for employing ceramic filters to filter molten metal. The continuous pusher-type slide gate valves have, according to the present invention, opening slide plates having passage openings therethrough with ceramic filters disposed therein. These plates are disposed on rails below an opening of the metallurgical vessel, and can be slid into and out of engagement with the opening of the metallurgical vessel, to open and close the pouring channel, on the rails. With this system, one plate having a clogged filter can be quickly and easily replaced by another plate having a clean filter.

BRIEF DESCRIPTION OF THE DRAWINGS

Preferred embodiments of the present invention are explained in detail below with reference to the accompanying drawings, in which.

DETAILED DESCRIPTION OF THE PREFERRED EMBODIMENTS

Figure 1:
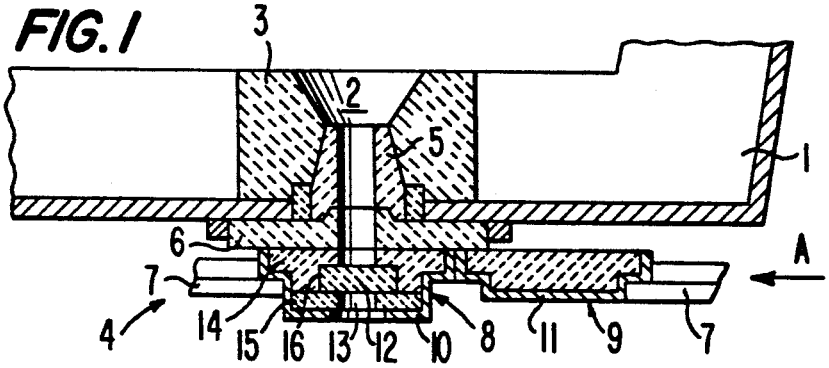
FIG. 1 is a cross-sectional view of a metallurgical vessel having a continuous pusher-type slide gate system employing ceramic filter plates.

FIG. 1 illustrates a metallurgical vessel 1, for example a tundish. The bottom of the metallurgical vessel 1 has a discharge opening 2 formed by a bottom brick 3. A continuous pusher-type slide gate valve system 4 has an inlet sleeve or inlet nozzle 5 disposed in the bottom brick 3. The system 4 is not illustrated in detail for the sake of simplicity. In the figure can be seen a stationary base plate 6 immediately below the inlet sleeve 5 and a pusher track 7 disposed below the stationary plate. Rectangular slide plates are linearly moved along the pusher track 7 below the stationary plate 6 in engagement therewith.

The rectangular slide plates, for example an opening plate 8 and a closing plate 9, can be moved below the stationary plate with a sealing engagement therewith to open or close the discharge opening 2. Both rectangular slide plates 8 and 9 are provided with a sheet-metal plate shell 10 and 11, respectively, supporting the plates on the pusher track 7. The plates are pushed along the pusher track 7 in a manner well known in the art in the direction as indicated by arrow A in FIG. 1 along the pusher track 7, and exit the pusher track 7, after being used, from the end opposite to the arrow A.

Opening plate 8, having a passage opening 13 therethrough, is used for the discharge of molten metal from the metallurgical vessel 1 through the discharge opening 2, while the closing plate 9 waits in reserve immediately adjacent the opening plate 8. The rectangular closing plate 9 can thereby be quickly and easily moved in the direction of arrow A to close off discharge opening 2, simultaneously moving the rectangular opening plate 8 away from the discharge opening 2 into an inoperative position.

A ceramic filter 12 is disposed in the passage opening 13 between two plate sections 14 and 15 of opening plate 8. Plate sections 14 and 15 are held together with the sheet-metal shell 10. The two plate sections 14 and 15 form a recess 16, lying horizontally on top of each other. The ceramic filter 12 is disposed in the recess 16 with its upper surface disposed perpendicularly to the direction of flow of the molten metal through the discharge opening 2 and passage opening 13. The ceramic filter 12 forms, with the opening plate 8, an interchangeable wearable refractory part which filters molten metal flowing out of the metallurgical vessel 1.

Filtration of the molten metal flowing out of the metallurgical vessel 1 can occur during the entire emptying process of the vessel 1, or, for example, during the end phases of the emptying process, in order to prevent impurities in the molten metal, whose presence therein gradually increases towards the end of the emptying process, from being poured along with the molten metal into a mold being filled. At the beginning of pouring, an opening plate 8 having no filter can be used by sliding the opening plate 8 along the pusher track 7 and dislodging the closing plate 9 from its closing position. When the end of the casting operation approaches, and an undesirable number of impurities may begin to be included with the molten metal flowing out of the metallurgical vessel, a further opening plate 8 can be moved into position by dislodging the filterless opening plate 8, the following opening plate 8 having a ceramic filter 12 in place.

The opening plate 8 having a ceramic filter 12 installed therein should be designed such that the time it takes for the ceramic filter 12 to clog approximately corresponds to the life span of the refractory plate material making up the opening plate 8.

Figure 2:
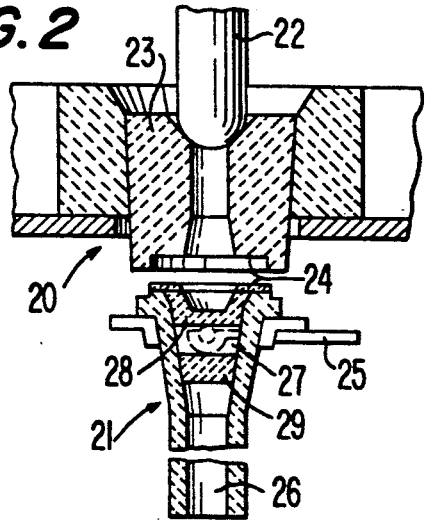
FIG. 2 is a cross-sectional view of a casting pipe employing a ceramic filter.

FIG. 2 illustrates a casting pipe 21 employing the concept of the present invention in a similar manner to the opening plate 8 having the ceramic filter 12 in the slide gate system of FIG. 1. A stopper unit 20 uses a stopper 22 to plug a nozzle 23 for controlling the outflow of molten metal from a metallurgical vessel. The casting pipe 21 can be interchangeably attached to the nozzle 23 by an appropriate supporting and changing mechanism 25. A seal 24 is placed between the casting pipe 21 and the nozzle 23.

The casting pipe 21 has a passage opening 26 therethrough, and an expanded portion 27 at the inlet end of the passage opening 26. The expanded portion 27 is conical, and has a basket shaped prefilter 28 for coarser impurities inserted therein. The prefilter 28 has a recess opening toward the source of the molten metal. Below the prefilter 28 is inserted a further ceramic filter 29 for finer impurities. As illustrated in FIG. 2, the two ceramic filters 28 and 29 may be spaced from each other along the expanded portion of the passage opening 26. The total filtering capacity is thus divided between the two ceramic filters 28 and 29. As in the embodiment of FIG. 1, the service life of the ceramic filters is chosen to correspond to the life span of the casting pipe 21.

Figure 3:
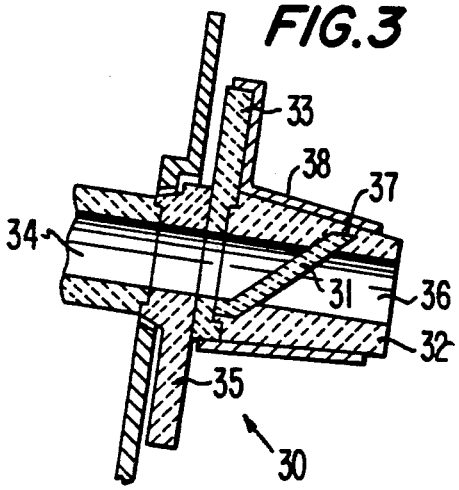
FIG. 3 is a cross-sectional view of a tapping slide gate valve employing a ceramic filter in a discharge sleeve.

FIG. 3 illustrates a tapping nozzle 30 for tapping molten metal from the side of a metallurgical vessel. A slide gate valve includes a slide plate 33 having a discharge sleeve or nozzle 32 connected thereto. The slide gate valve has a passage opening 36 therein connecting with a discharge channel 34 of the metallurgical vessel. A stationary base plate 35 is also mounted to the metallurgical vessel for interaction with the slide plate 33. A plate shaped ceramic filter 31 is disposed in the passage opening 36 for filtering of the molten metal flowing therethrough. A groove 37 is formed on the inside of the discharge sleeve 32 for holding the plate shaped ceramic filter 31 therein. The ceramic filter 31 thus lies diagonally in the passage opening, having a peripherally elliptical shape due to its diagonal positioning in the discharge sleeve 36. This positioning increases the amount of filtering surface presented by the ceramic filter 31 to the molten metal flowing through the passage opening 36 with respect to the cross-sectional area of the passage opening 36. A metallic pusher frame 38 houses and holds the wearable parts together, i.e. the discharge sleeve 32, the ceramic filter 31 and the slide plate 33. These parts can then all be replaced at the same time. At the same time, the stationary plate 35 can also be replaced.

Figure 4:
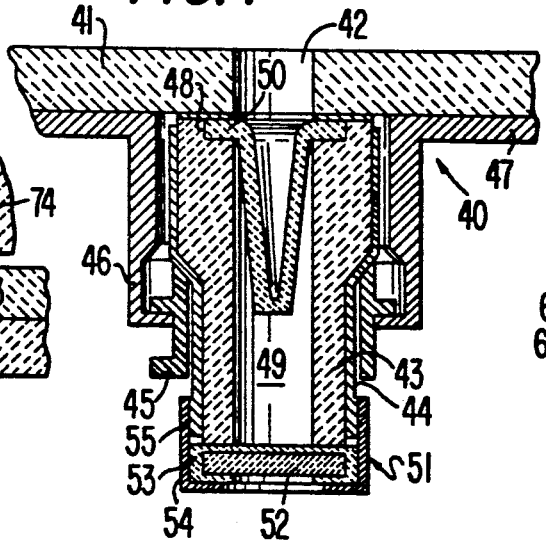
FIG. 4 is a cross-sectional view of a collector nozzle of a slide gate valve employing a ceramic filter arrangement.

FIG. 4 illustrates a nozzle arrangement 40 typical for linear, rotary and swivel slide gate valves. This arrangement has a sliding valve plate 41 with a passage opening 42 therethrough. A discharge sleeve or nozzle 43 is connected to the slide valve plate 41, and can be replaced independently of other wearable parts of the nozzle arrangement 40. Discharge sleeve 43 has a metal shell 44 encasing its refractory material. A metallic coupling member 45 surrounds the metal shell 44 and can be coupled with a coupling member 46. The coupling member 46 is formed as part of a metal frame 47 encasing the nozzle arrangement 40. The entire arrangement can be used as a slide plate in a pusher-type arrangement.

A recess or countersink 48 is formed at the inlet portion of the discharge sleeve 43. A basket shaped ceramic filter 50 is supported in the recess 48 and extends into a passage opening 49 of the discharge sleeve 43. If so desired, the ceramic filter 50 can be removed from the recess 48 and replaced with a sealing ring for the unfiltered passage of molten metal. A filter unit 51 is connected to the discharge end of the discharge sleeve 43. The filter unit 51 has a circular plate shaped ceramic filter 52 mounted in a sheet metal casing 54. A sealing material 53 is disposed in the sheet metal casing 54 about the periphery of the ceramic filter 52 to mount the filter in the casing 54. Threads 55 are provided on the casing 54 so that the casing can be screwed onto the discharge end of the discharge sleeve 43, connecting to the metal shell 44. The nozzle arrangement 40 can then filter melt selectively, either with one ceramic filter or two ceramic filters. The filter unit 51 is easily attached to or detached from the filter unit 51, so that the filter unit 51 can be used as is necessary.

Figure 5:
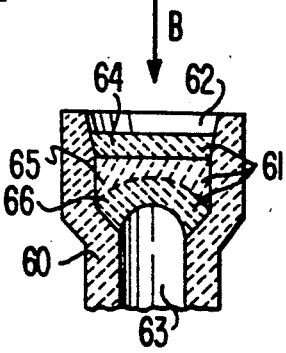
FIG. 5 is a cross-sectional view of a variation of the collector nozzle according to FIG. 4.

FIG. 5 illustrates an alternative discharge sleeve 60 that can be used in the nozzle arrangement 40 of FIG. 4. Only the upper portion of the discharge sleeve 60 is illustrated. The discharge sleeve 60 has an expanded portion 62 at the inlet end of a passage opening 63 extending therethrough. As can be seen from the figure, the passage opening 63 is cylindrical, and connects to a conical portion of the expanded portion 62. The expanded portion 62 further has a cylindrical portion extending upwardly from the conical portion, and a further conical portion extending to the end of the passage opening 63. A multi-stage ceramic filter 61 is disposed as a unit in the expanded portion 62 of the passage opening 63. The ceramic filter 61 has, as seen from the flow direction B of the molten metal, a coarse porous filter 64, an absorption or reaction filter 65 and a fine porous filter 66. Thus, in addition to the mechanical filtering of solids by filters 64 and 66, even dissolved impurities can be removed from the molten metal with the absorption or reaction filter 65.

Figure 6:
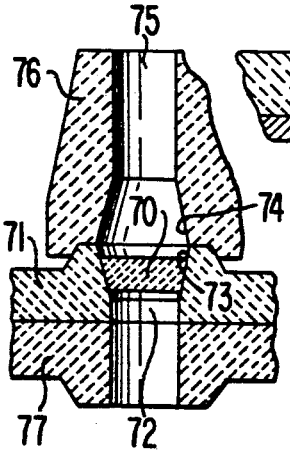
FIG. 6 is a cross-sectional view of a stationary plate in a slide gate nozzle employing a ceramic filter arrangement according to the present invention.

The stationary base plate and the inlet sleeve or nozzle of the slide gate are not as accessible as the other wearable parts discussed above, but in certain cases it can be advantageous to install ceramic filters at these points. Noting FIG. 6, there is illustrated a conical ceramic filter 70 installed in a passage opening 72 of a stationary base plate 71 of a slide gate valve. The passage opening 72 has a conical expanded portion 73 at its inlet side. Placed above the stationary base plate 71 is an inlet nozzle or sleeve 76 having a passage opening 75 therethrough. A conical expanded portion 74 of the passage opening 75 at the discharge end of the inlet sleeve 76 is essentially a mirror image configuration of the conical expanded portion 72 of the passage opening 72 of the stationary base plate 71. A sliding valve plate 77 forms a seal with the stationary base plate 71, and can be moved to open, shutoff and throttle the flow of molten metal. The molten metal stream flowing through the valve parts 76, 71 and 77 undergoes a cross sectional expansion in the inlet sleeve 76 at the expansion 74 to increase the cross-sectional area of the molten metal exposed to the ceramic filter 70. The capacity of the ceramic filter 70 is increased by the increase in cross-sectional area due to the conical expansions 74 and 73.

Those of skill in the art will recognize that other combinations of ceramic filters with various wearable parts of molten metal valves and nozzles are possible, and should be considered within the scope of the present invention as defined by the attached claims.

I claim:

1. A molten metal flow control arrangement for a metallurgical vessel, said molten metal flow control arrangement comprising:

means defining a flow channel for the flow of molten metal from the interior of the metallurgical vessel to the exterior thereof; and a valve means for opening an closing said flow channel for allowing or stopping the flow of molten metal from the interior of the metallurgical vessel to the exterior thereof;

wherein one of said means defining a flow channel and said valve means comprises an interchangeable wearable refractory part, said interchangeable wearable refractory part comprising a refractory body having a passage opening therethrough for the passage of molten metal and at least one ceramic filter mounted in said passage opening of said refractory body for filtering molten metal flowing through said passage opening of said refractory body.

2. The molten metal flow control arrangement of claim 1, wherein said interchangeable wearable refractory part forms a part of a slide gate which forms a part of said valve means, said valve means further having a stationary plate fixed at an outer end of said means defining a flow channel, said stationary plate having an opening therethrough in line with said flow channel and a lower sliding surface, and said slide gate having an upper sliding surface for engagement with said lower sliding surface of said stationary plate.

3. The molten metal flow control arrangement of claim 2, wherein said refractory body of said slide gate has said sliding surface thereon and has a recess surrounding said passage opening, said ceramic filter being disposed in said recess.

4. The molten metal flow control arrangement of claim 3, wherein said slide gate further has a plate section holding said ceramic filter in said recess and a sheet-metal shell holding said refractory body and said plate section together.

5. The molten metal flow control arrangement of claim 4, wherein said sheet metal shell has a shoulder for slidable movement on a pusher track, and said valve means further comprises at least one further slide gate having no passage opening therethrough.

6. The molten metal flow control arrangement of claim 2, wherein said slide gate further comprises a sliding valve plate with said upper sliding surface thereon and wherein said refractory body is a discharge sleeve connected to the underside of said sliding valve plate.

7. The molten metal flow control arrangement of claim 6, wherein said discharge sleeve has an elliptical groove therein surrounding said passage opening, said ceramic filter being disposed in said groove.

8. The molten metal flow control arrangement of claim 6, wherein said slide gate further comprises a coupling means for detachably and interchangeably coupling said discharge sleeve to said sliding valve plate of said slide gate.

9. The molten metal flow control arrangement of claim 6, wherein said discharge sleeve has a recess at an upper end thereof adjacent said sliding valve plate receiving said ceramic filter therein.

10. The molten metal flow control arrangement of claim 9, wherein said discharge sleeve further comprises a second ceramic filter detachably connected to a lower end thereof.

11. The molten metal flow control arrangement of claim 10, wherein said second ceramic filter comprises means for detachably mounting said second ceramic filter to said lower end.

12. The molten metal flow control arrangement of claim 11, wherein said means for detachably mounting comprises threads provided on a metal casing of said second ceramic filter engageable with threads on a metal casing of said discharge sleeve.

13. The molten metal flow control arrangement of claim 9, wherein said ceramic filter depends down into said passage opening from said recess and is upwardly concave.

14. The molten metal flow control arrangement of claim 6, wherein said discharge sleeve has an expanded portion at an upper end thereof in said passage opening of a greater diameter than the lower end of said passage opening, said expanded portion having three said ceramic filters therein, a first said ceramic filter being a coarse porous filter and a second said ceramic filter being a fine porous filter, a third said ceramic filter being disposed between said first and second ceramic filters and comprising an absorption or reaction filter.

15. The molten metal flow control arrangement of claim 1, wherein said means defining a flow channel comprises a nozzle and said refractory body, said refractory body being a casting pipe having a supporting and changing mechanism for interchangeably supporting said casting pipe below said nozzle.

16. The molten metal flow control arrangement of claim 15, wherein said casting pipe has an outwardly tapering upper end having two said ceramic filters therein, a first said ceramic filter being a coarse porous filter and a second said ceramic filter being a fine porous filter, said first ceramic filter being concaved upwardly.

17. The molten metal flow control arrangement of claim 1, wherein said interchangeable wearable refractory part forms a part of said valve means, said refractory body being a stationary valve plate fixed at an outer end of said means defining a flow channel and having a lower sliding surface, said valve means further comprising a sliding valve plate engaging said lower sliding surface.

18. The molten metal flow control arrangement of claim 17, wherein said passage opening in said stationary plate has an upper conical portion, said ceramic filter being disposed in said conical portion.

19. A slide gate for use in a valve for opening and closing a flow channel of a metallurgical vessel for allowing or stopping the flow of molten metal from the interior of the metallurgical vessel to the exterior thereof, said slide gate comprising:

a refractory body comprising a passage opening extending therethrough for the flow of molten metal therein and a flat upper sliding surface adapted for sliding engagement with a stationary plate of the valve;

at least one ceramic filter in said passage opening extending through said refractory body for filtering molten metal flowing through said passage opening; and mounting means for mounting said at least one ceramic filter in said passage opening of said refractory body.

20. The slide gate of claim 19, wherein said mounting means comprises a recess surrounding said passage opening, said ceramic filter being disposed in said recess.

21. The slide gate of claim 20, wherein said refractory body has a first, upper plate section having said sliding surface thereon and said recess therein, a second, lower plate section holding said ceramic filter in said recess, and a sheet-metal shell holding said first and second plate sections together.

22. The slide of claim 21, wherein said sheet metal shell has a shoulder adapted for slidable movement on a pusher track.

23. The slide gate of claim 19, wherein said refractory body comprises a discharge sleeve connected to a sliding valve plate, said sliding valve plate having said flat upper sliding surface thereon, and said mounting means being provided on said discharge sleeve.

24. The slide gate of claim 23, wherein said mounting means comprises an elliptical groove in said discharge sleeve surrounding said passage opening.

25. The slide gate of claim 23, wherein said slide gate further comprises a coupling means for detachably and interchangeably coupling said discharge sleeve to said sliding valve plate.

26. The slide gate of claim 23, wherein said mounting means comprises a recess at an upper end of said discharge sleeve adjacent to said sliding valve plate.

27. The slide gate of claim 26, wherein said mounting means detachably and replaceably mounts said a second said ceramic filter to the lower end of said discharge sleeve.

28. The slide gate of claim 27, wherein said mounting means comprises threads provided on a metal casing of said second ceramic filter engageable with threads on a metal casing of said discharge sleeve.

29. The slide gate of claim 26, wherein said ceramic filter depends down into said passage opening from said recess and is upwardly concave.

30. The slide gate of claim 23, wherein said mounting means in said discharge sleeve comprises an expanded portion at an upper end thereof in said passage opening of a greater diameter than the lower end of said passage opening, said expanded portion having three said ceramic filters therein, a first said ceramic filter being a coarse porous filter and a second said ceramic filter being a fine porous filter, a third said ceramic filter being disposed between said first and second ceramic filter and comprising an absorption or reaction filter.

31. A casting pipe for use with a nozzle of a molten metal vessel, said casting pipe comprising:

an elongated tubular refractory body having a passage opening therethrough comprising a cylindrical portion and an upper conical end integral with said cylindrical portion adapted for engagement with the nozzle of the molten metal vessel;

support means on said upper conical end of said refractory body for supportably connecting said refractory body with a supporting and changing mechanism so that said refractory body can be replaced and interchanged in use with the nozzle; and at least one ceramic filter disposed in said upper conical end of said passage opening of said refractory body for filtering molten metal flowing through said passage opening.

32. The casting pipe of claim 31, wherein there are two said ceramic filters, comprising a first said ceramic filter being a coarse porous filter and a second said ceramic filter being a fine porous filter, said first ceramic filter being concaved upwardly.

33. The casting pipe of claim 32, wherein said two ceramic filters are spaced from each other in said passage opening.

34. A stationary plate for use in a valve for opening and closing a flow channel of a metallurgical vessel for allowing or stopping the flow of molten metal from the interior of the metallurgical vessel to the exterior thereof, said stationary plate comprising:

a refractory body comprising a passage opening extending therethrough for the flow of molten metal therein and a flat upper sliding surface adapted for sliding engagement with a stationary plate of the valve;

at least one ceramic filter in said passage opening extending through said refractory body for filtering molten metal flowing through said passage opening; and mounting means for mounting said at least one ceramic filter in said passage opening of said refractory body.

35. The stationary plate of claim 34, wherein said mounting means comprises an upwardly expanding conical portion of said passage opening having said ceramic filter disposed therein.

* * * * *